United States Patent [19]

Jundt et al.

[11] 4,077,379

[45] Mar. 7, 1978

[54] INTERNAL COMBUSTION ENGINE SEMI-CONDUCTOR IGNITION CONTROL SYSTEM

[75] Inventors: Werner Jundt, Ludwigsburg; Bernd Bodig, Leinfelden; Helmut Roth, Stuttgart; Gerhard Söhner, Remshalden; Peter Werner, Stuttgart, all of Germany

[73] Assignee: Robert Bosch GmbH, Stuttgart, Germany

[21] Appl. No.: 724,976

[22] Filed: Sep. 20, 1976

[30] Foreign Application Priority Data

Sep. 25, 1975 Germany ..... 2542677

[51] Int. Cl.[2] ..... F02P 1/00

[52] U.S. Cl. ..... 123/148 S; 315/209 T

[58] Field of Search ..... 123/148 E, 148 S; 315/209 T, 209 R

[56] References Cited

U.S. PATENT DOCUMENTS 3,745,985 7/1973 Hohne ..... 123/148 S 3,854,466 12/1974 Steinberg ..... 123/148 S

FOREIGN PATENT DOCUMENTS 1,539,168 11/1969 Germany ..... 123/148 S

*Primary Examiner*—Ronald B. Cox

*Attorney, Agent, or Firm*—Flynn & Frishauf

[57] ABSTRACT

To prevent generation of a spurious spark at the spark plug if the distributor braker control assembly should have commanded an ignition control transistor to be conductive and when the ignition switch is disconnected under those conditions, thus cutting off power to the ignition control transistor rendering it non-conductive and causing spurious voltage pulses which results in a spark at the ignition, a control path is provided connected to a control transistor for the actual ignition transistor and connected in circuit with the current flow due to the energy stored in the ignition coil to control the emitter-collector path of the ignition switching transistor to continue to remain conductive for a short period of time to drain off the stored energy in the coil, although the main ignition switch has been opened.

17 Claims, 3 Drawing Figures

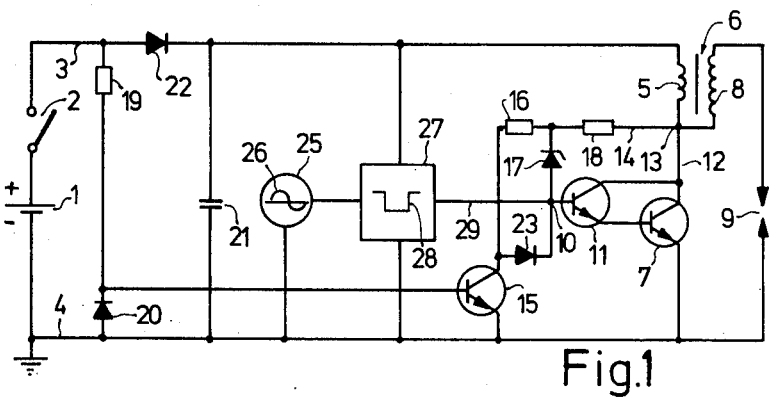
Fig.1
Fig.2
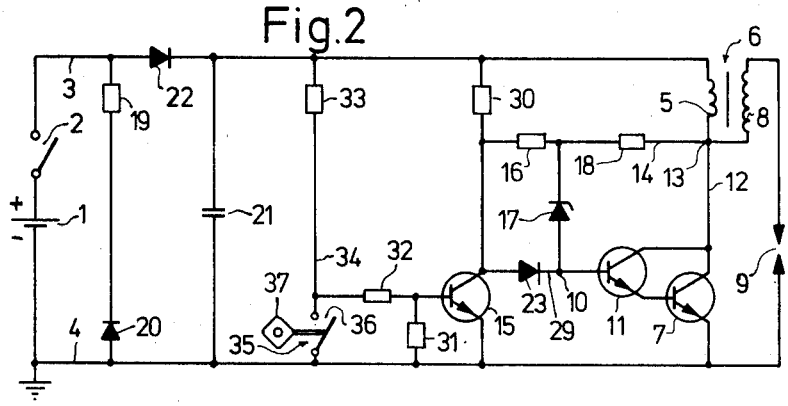
Fig.3
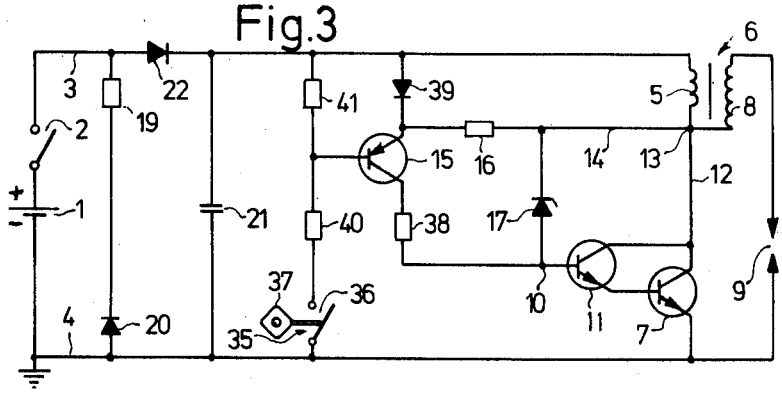

INTERNAL COMBUSTION ENGINE SEMI-CONDUCTOR IGNITION CONTROL SYSTEM

The present invention relates to a semi-conductor ignition control system for internal combustion engines and more particularly, to a transistorized ignition system in which a switching transistor has its emitter-collector path connected in series with the primary winding of an ignition coil.

Various types of transistorized ignition systems are known. These systems are customarily connected to the vehicle battery forming a dc power source, and further connected in series with the ignition switch. If the ignition switch is interrupted, the ignition control transistor will no longer have current applied thereto and thus change to blocked state. If, just before the main ignition switch has been turned off, the ignition control transistor was conductive, however, the sudden interruption of current flow therethrough may lead to a spurious peak at the secondary of the ignition coil.

Transistorized ignition systems have the advantage that they can be controlled by contact-less control systems and, if mechanical contents are used, the mechanical contents have to carry only very small control current and thus will last for a long time.

One type of transistorized ignition system — see BOSCH-Kraftfahrtechnisches Taschenbuch, 1961, VDI-Verlag GmbH, Duesseldorf, p. 326 (BOSCH Handbook of Vehicular Technology) — may result in spurious sparks if the main ignition switch is opened just at that time, or condition, if the emitter-collector path of the transistorized ignition system main transistor happens to be conductive. The ignition coil will then cause an ignition spark to occur at the respective spark plug. This spark at the spark plug can ignite compressed fuel-air mixture in the cylinder at an entirely undesirable. instant of time so that the engine can be severely strained.

It is an object of the present invention to provide a safety control system for transistorized ignition systems in which stresses on the engine due to spurious sparks are avoided.

SUBJECT MATTER OF THE PRESENT INVENTION

Briefly, a control path is provided for a control transistor of the main ignition transistor which branches current stored in the ignition coil and released upon disconnection of the main ignition switch, this current being used to temporarily control the main ignition control transistor to remain conductive for a sufficient period of time to permit decay of the current stored in the ignition coil by flowing through the ignition transistor, thus providing for gradual dissipation of the energy stored in the ignition coil and inhibiting formation of a spark at the spark plug.

The invention will be described by way of example with reference to the accompanying drawings wherein:

FIG. 1 illustrates a circuit diagram of a transistorized ignition system and having the additional control feature in accordance with the present invention;

and FIGS. 2 and 3 are circuit diagrams of modified embodiments of ignition systems and control circuits in accordance with the present invention.

The ignition system of FIG. 1 is used in combination with an internal combustion engine (not shown), typically, an automotive internal combustion engine. Current supply is derived from a battery 1, which, typically, is the vehicle battery.

The main ignition switch 2 is connected in series with battery 1 and places positive supply bus 3 and ground and chassis bus 4 in energized condition, when closed. A branch from bus 3 goes through ignition coil 5 and main switching transistor 7, the emitter of which is connected to chassis bus 4. The secondary winding 8 of ignition coil 6 is connected to spark plug 9. Of course, a suitable distributor may be interposed between the secondary 8 and a plurality of spark plugs from multi-cylinder engines.

If current is applied at a control junction 10, the transistor 7 will be rendered conductive. The control junction 10 in a simple case may be the base terminal of switching transistor 7; in the preferred embodiment, however, a driver transistor 11 is provided, connected with transistor 10 in a Darlington Circuit, so that the junction 10 is connected to the base of transistor 11, the collector of which is connected to the collector of transistor 7 and the emitter of which is connected to the base transistor 7.

The connection between terminal 13 of the primary of ignition coil 5 and the collector of transistor 7 is indicated at 12. Terminal 13 is connected to a branch circuit 14 forming a control branch in which the emitter-collector path of a control transistor 15 is located. The branch 14 is connected at its other terminal to a chassis bus 4. It includes, starting from junction 13, a control resistor 16 connected to the collector of transistor 15. A Zener diode 17 is connected between the resistor 16 and junction 10. The breakdown voltage of Zener diode 17 can be reduced by including a further resistor 18 between junction 13 and resistor 16. Thus, a more inexpensive element than the high voltage Zener diode 17 or a plurality of Zener diodes 17 can be avoided by a simple resistor. A branch circuit including auxilliary resistor 19 and auxilliary diode 20 are connected across the supply line busses 3, 4. Diode 20 is poled in blocking direction with respect to the voltage from battery 1. A capacitor is connected in parallel with primary winding 5 and the collector-emitter path of the switching transistor 7.

A diode 22 poled in conductive direction is located in the supply line 3 between the junction to the auxilliary resistor 19 and the connection of capacitor 21. Diode 22 protects the system against inadvertent reverse polarity connection of the battery 1.

A control transistor 13 has its base connected to the junction between the auxilliary resistor 19 and auxilliary diode 20. Its collector is connected to an anode of a diode 23, the cathode of which is connected to junction 10.

Ignition is triggered by means of a signal source 25 which generates in a wave shaping stage 27 a pulse 28 having a reverse polarity with respect to the output wave 26 from signal generator 25. Each positive half wave from the signal generator 25 operating similarly to an ac generator results in a negative pulse 28. During occurrence of the negative pulse, on its output line 29, current flow to the junction 10 is inhibited.

OPERATION

The system is ready to operate upon the closing of switch 2. If, at that moment, current flows over connection 29 to junction 10, then the current can continue over the base-emitter path of the driver transistor 11 and and the base-emitter path of switching transistors 7 and return through the second chassis bus 4. Transistors 11, 7 will have conductive emitter-collector paths. The driver transistor 7 will, additionally, carry control current to the base-emitter path of the switching transistor 7 and thus, a comparatively low current in the line 29 can provide for effective control of the emitter-collector path of the switching transistor 7. The primary winding 5 will have a relatively high current flowing thereto, and ignition energy is stored in the ignition coil 6.

When the ignition switch 2 is operated, the emitter-collector path of the control transistor 15 will be continuously conductive, since current through the auxilliary resistor 19 can flow through the base-emitter path of transistor 15. The control resistor 16 is of high value; thus, a relatively small current will flow over the control branch 14 to the second supply bus 4. The current flowing over the connecting line 29 from wave shaping circuit 27 cannot drain off the emitter-collector path of the control transistor 15 to the bus 4 due to the presence of the diode 23.

Upon rotation of the engine, the signal source 25 will provide a positive half wave, and, as a consequence, the wave shaping stage 27 will provide a negative pulse 28. No further control current will flow over line 29. Transistors 11, 7 will block. A high voltage pulse will result in the secondary 8 of the coil 6, resulting in the spark at the spark plug 9. Before a dangerously high voltage value is reached, across the emitter-collector path of switching transistor 7, Zener diode 17 will break down and carry current which permits the emitter-collector paths of the two transistors 11, 7 to remain slightly conductive, and prevent further rise in voltage.

As soon as the pulse 28 from the wave shaping circuit 27 has decayed, current can again flow over the connection 29 which again controls the emitter-collector paths of the transistors 11, 7 to conductive state and thus again causes current flow of substantial level through the primary 5 of ignition coil 6. The cycle can then repeat.

If under conditions of current flow through the transistors 11, 7 the ignition switch 2 should be opened, then current through the primary winding 5 will be interrupted just as if the transistors 11, 7 would block; if no arrangements are made to control this current flow, a high voltage pulse will arise in the secondary winding 8 resulting in the spark at spark plug 9.

In accordance with the present invention, such a spurious spark due to opening of the ignition switch 2, rather than due to action of the ignition control system itself, is inhibited. The control transistor 15 will block, thus interrupting the emitter-collector path upon disconnection of supply potential due to opening of switch 2. The inductive voltage arising in the primary winding 5 upon opening of the ignition switch 2, will, however, cause an induction current to flow in reverse direction with respect to that of the current from the battery 1. This reversely directed induction current can flow over resistor 18, resistor 16, diode 23, junction 10, and then to the base-emitter paths of transistors 11, 7 and to chassis bus 4. The circuit is closed over the auxilliary diode 20 and auxilliary resistor 19 as well as over the reverse polarity protecting diode 22, back to the primary winding 5. The emitter-collector paths of the two transistors 11, 7 thus will become conductive, permitting the induction current to flow over the emitter-collector path of the switching transistor 7 and over the auxilliary diode-resistor circuit 20, 19. This current will decay rapidly and the induction voltage will not provide a high voltage pulse at the secondary sufficient to cause a spurious spark at spark plug 9. The auxilliary resistor 19 must be selected to be of relatively low resistance. The auxilliary diode 20 blocks current flow under normal connected conditions, so that no current is drained from the battery 1 under operating conditions. The capacitor 21 can also discharge and additionally assist the induction current in its control effect.

EMBODIMENT OF FIG. 2

The basic difference between the circuits of FIGS. 1 and 2 is this: The control npn transistor 15 is also used to trigger the ignition event. The collector of control transistor 15 is further connected by a resistor 30 with the positive supply bus 3; the connection 29 is formed by the connection from the collector to the switching junction 10, and which includes the diode 23.

The base of the control transistor 15 is connected to a voltage divider formed of resistors 31, 32 and 33, and connected between the positive and negative supply busses 3, 4. The base of transistor 15 is connected to the junction formed between resistors 31, 32, connected as shown. The junction 34 between resistors 32, 33 is connected to the movable contact 36 of a breaker assembly 35 operated by a mechanical cam 37. When the switch 35 is open, so that current therethrough is blocked, the emitter-collector path of switching transistor 7 should also block.

The ignition breaker assembly 35 is formed by a mechanical assembly which is rotated in synchronism with rotation of the internal combustion engine, the switch 35 being operated by the cam 37.

All other elements correspond to those of FIG. 1 and will not be described again.

OPERATION OF CIRCUIT OF FIG. 2

Let it be assumed that the breaker contact 36 is closed. This short circuits the supply of biased voltage to the base of transistor 15, and transistor 15 will block. Current can thus flow through resistor 30 and diode 23 to the switching junction 10 and, as in FIG. 1, cause the Darlington pair 11, 7 to become conductive so that a high current will flow through the primary winding 5 of ignition coil 6. At the ignition instant, breaker contact 36 is opened by cam 37. Current can then flow to the base of transistor 15, rendering transistor 15 conductive, and draining off current through transistor 30. Switching junction 10, and hence the base of transistor 11 will no longer have current supplied thereto, which will cause the emitter-collector path of the main switching transistor 7 to change to blocked state, causing an ignition pulse at the secondary 8 of the spark plug.

Upon reclosing of the breaker 36, the emitter-collector path of the switching transistor again changes to blocked state, the emitter-collector path of transistors 11, 7 will become conductive and the cycle will repeat, storing a substantial ignition energy in the ignition coil 6 due to current flow therethrough.

Upon opening of the main ignition switch 2, an induction voltage will arise in primary winding 5.

In accordance with the present invention, an induction current can flow over resistors 18, 16, diode 23 to the Darlington pair 11, 7 and then return through the branch circuits formed by the voltage divider 31, 32, junction 34, 33 back to the positive bus 3 as well as through auxilliary diode 20 and auxilliary resistor 19. The now-conductive emitter-collector path of the switching transistor 7 will permit the induction current to decay without generating a spark.

EMBODIMENT OF FIG. 3

The difference between FIGS. 2 and 3 is essentially in the difference in type of control transistor 15. Transistor 15 is a pnp transistor. Its collector is connected through resistor 38 to the junction 10 and its emitter is connected to the control resistor 16 and hence, to the junction 13, forming the control branch 14. A diode 39, poled in conductive direction is connected in parallel to the ignition coil 5 and is likewise connected to the emitter of transistor 15. The additional limiting resistor 18 is not used. The breaker switch 36 is connected through a voltage divider formed of resistors 40, 41 to the positive bus 3, the tap point of which is connected to the base of transistor 15. The voltage divider circuit is not strictly necessary and resistor 41 could be omitted.

OPERATION OF CIRCUIT OF FIG. 3

When the breaker contact 36 is closed, control current can flow over diode 39, the base-emitter path of transistor 15 and resistor 40. The emitter-collector path of transistor 15 becomes conductive and current will flow over resistor 38 to the Darlington pair 11, 7. The emitter-collector path of switching transistor 7 will become conductive, causing high current flow through the primary 5 of the ignition coil and storing ignition energy.

At the ignition instant, breaker 36 opens, and the emitter-collector paths of transistors 15, 11, 7 all will become non-conductive. The high current in the primary winding 5 will be interrupted and an ignition pulse generated in the secondary 8 of coil 6.

Upon reclosing of the breaker 36 the emitter-collector path of switching transistor 7 will become conductive again, as described above and the cycle will repeat. The present invention now becomes effective if, at that condition, the ignition switch 2 is opened. The induction current from the primary winding 5 can then flow through resistor 16 and the emitter-base path of the control transistor 15, the return path of the current to the primary 5 being through resistor 40, switch 36, auxilliary diode 20, auxilliary resistor 19 and reverse polarity protective diode 22. The emitter-collector path ot the transistor 15 will thus be rendered conductive, and current can then flow through resistor 38 to junction 10, rendering the Darlington pair conductive, again permitting decay of the induction current 5 at a reasonable rate without causing an ignition spark pulse at the secondary 8 of the ignition coil 6.

The diode 39 prevents short circuiting of the induction current therethrough without taking the path through the transistor 15 and thus merely acting as a free-wheeling diode, without having control effect. It does, however, permit control of the transistor 15 by the breaker switch 36.

The mechanical switch 35 (FIGS. 2, 3) may, of course, be replaced by a semi-conductor, for example, the emitter-collector path of a transistor, or it can be controlled, as in FIG. 1 over one or more flip flop circuits.

Various changes and modifications may be made and features described in connection with any one of the embodiments may be used with any one of the others, within the scope of the inventive concept.

We claim

1. Semiconductor controlled ignition system for an internal combustion engine having a master ignition switch (2);

an ignition coil (6);

a main switching transistor (7), the emitter-collector path of which is connected in series with the primary (5) of the ignition coil (6) and having a control terminal (10) controlling the conduction state thereof;

ignition control switching means (25, 27; 35) connected to said control terminal (10) of the main switching transistor (7) and controlling said main switching transistor selectively for conduction of current to store ignition energy in the coil and for blocking, to interrupt current flow through the primary (5) of the ignition coil (6) and thereby generate an inductive voltage pulse in the secondary (8) of the ignition coil to provide a spark pulse;

and comprising, in accordance with the invention means to prevent generation of a spurious spark pulse upon opening of the master ignition switch (2) during a period of current flow of the main switching transistor (7) including a protective circuit branch (14) connected in parallel with the primary (5) of the ignition coil (6) and including means (15) rendering said circuit branch conductive to inductive current from the ignition coil upon the opening of the master ignition switch (2) and thus interruption of power supply to the main switching transistor, said protective circuit branch (14) being connected to said control terminal (10) for the main switching transistor (7) and conducting a portion of the inductive current thereto to hold the main switching transistor (7) in at least partial conduction and permit gradual decay of the current flow through the primary (5) of the ignition coil and thus inhibit a spark pulse.

2. System according to claim 1 wherein the means rendering the protective circuit branch conductive to inductive current includes the emitter-collector path of a control transistor (15).

3. System according to claim 3 wherein the protective circuit branch (14) is connected to the junction (12, 13) between the primary (5) of the ignition coil and the emitter-collector path of the main switching transistor (7).

4. System according to claim 1 wherein the system includes a direct current supply source (1), the source being connected with its positive terminal through the main ignition switch (2) to one terminal of the primary (5) of the ignition coil, the other terminal of the primary (5) of the ignition coil (6) forming a junction (12, 13) connected in series with the collector-emitter path of the main switching transistor (7).

5. System according to claim 3 wherein the means rendering the protective circuit branch conductive to inductive current includes the emitter-collector path of a control transistor (15) and a control resistor (16) connects the junction (12) between the primary (5) of the ignition coil (6) and the emitter-collector path of the main switching transistor (7) to the emitter-collector path of the control transistor (15), whereby the junction, additionally, is connected to said control resistor (16), said junction forming one terminal (13) of the protective circuit branch (14).

6. System according to claim 5 wherein (FIG. 1.) the base of the control transistor (15) is continuously connected to the main power supply of the system when the master ignition switch (2) is closed to then render said transistor continuously conductive.

7. System according to claim 5 (FIGS. 2, 3) including circuit means (31, 32, 33, 34; 40, 41) connecting the ignition control switching means (35) to the base of the control transistor (15), the control transistor being connected to the main switching transistor (7) to control the conduction of the main switching transistor in accordance with conduction of the control transistor, as commanded by operation of the ignition control switching means (35).

8. System according to claim 5 wherein (FIGS. 1, 2) a dc power supply (1) for the system is provided, the main ignition switch (2) being connected in the positive line, or bus, from the power supply (1);

and wherein the control transistor (15) has its collector connected to the starting terminal (13) of the protective circuit branch (14), the collector being additionally connected (23) to said control terminal (10) for the main switching transistor, the emitter of the control transistor (15) being connected to the negative, or ground, or chassis bus and connected to the negative terminal of the power supply.

9. System according to claim 8 further comprising an additional resistor (18) connected between the control resistor (16) and the starting terminal (13) of the protective circuit branch (14), and a Zener diode (17) connected to the common connection of the two resistors (16, 18) and to the control terminal (10).

10. System according to claim 5 further comprising a connecting diode (23) connecting the junction between the control transistor (15) and the control resistor (16) to the control terminal for the main switching transistor (7).

11. System according to claim 10 wherein the diode (23) has its anode connected to the collector of the control transistor (15) and its cathode to the control terminal (10), and wherein the emitter of the control transistor (15) is connected to negative, or ground, or chassis potential.

12. System according to claim 5 wherein (FIG. 3) the emitter of the control transistor (15) is connected over the control resistor (16) with the junction (12) forming the starting terminal (13) of the protective circuit branch (14), the emitter of the control transistor (15) being in conductive circuit relation (39) with the positive current supply from the matster ignition switch (2) is closed, the collector of the control transistor being connected to the control terminal (10) for the main switching transistor (7).

13. System according to claim 12 wherein a coupling diode (39) is providing connecting the emitter of the control transistor (15) with the positive terminal of the power supply (1), the anode of the diode (39) being connected to the terminal of the primary (5) of the ignition coil (6) which is removed from the junction (12) forming the starting terminal (13) of the protective circuit branch (14).

14. System according to claim 1 further comprising a capacitor (21) connected in parallel with the series circuit formed by the primary (5) of the ignition coil and the emitter-collector path of the main switching transistor (7).

15. System according to claim 1 further comprising an auxilliary circuit branch including at least an auxilliary resistor (19) connected in parallel with the series circuit formed by the primary (5) of the ignition coil (6) and the emitter-collector path of the main switching transistor (7).

16. System according to claim 1 further comprising a dc power supply (1), and wherein the auxilliary circuit branch additionally includes a diode (20) poled in blocking direction with respect to the power supply.

17. System according to claim 16 wherein (FIG. 1) the means rendering the protective circuit branch conductive to inductive current includes the emitter-collector path of a control transistor (15);

and wherein the base of the control transistor (15) is connected to the junction between the auxilliary resistor (19) and the auxilliary diode (20) connected in series therewith.

* * * * *